US006687944B2

(12) United States Patent
Young

(10) Patent No.: US 6,687,944 B2
(45) Date of Patent: Feb. 10, 2004

(54) MOP HEAD WITH BINDER STRIP

(76) Inventor: Scot Young, Hill Road, Lye, Stourbridge, West Midlands (GB), DY9 8HG ( * ) Notice: Subject to any disclaimer, the term of this patent is extended or adjusted under 35 U.S.C. 154(b) by 214 days.

(21) Appl. No.: 10/054,242

(22) Filed: Jan. 21, 2002

(65) Prior Publication Data

US 2003/0135949 A1 Jul. 24, 2003

(51) Int. Cl.[7] ..... A47L 13/20
(52) U.S. Cl. ..... 15/228; 15/209.1
(58) Field of Search ..... 15/209.1, 228, 15/229.1, 229.2, 229.6; 300/21

(56) References Cited

U.S. PATENT DOCUMENTS 4,675,932 A * 6/1987 Hofacker, Jr. ..... 15/118
4,951,341 A * 8/1990 Shears ..... 15/228
4,995,133 A * 2/1991 Newell ..... 15/229.1
5,217,787 A * 6/1993 Monahan ..... 428/134
5,638,569 A * 6/1997 Newell ..... 15/229.6
6,006,932 A * 12/1999 Morini ..... 215/249
6,131,233 A * 10/2000 Bolton et al. ..... 15/229.1
6,161,242 A * 12/2000 Cabrero Gomez et al. 15/147.1
2001/0052162 A1 12/2001 Young ..... 15/229.2
2003/0088936 A1 * 5/2003 Young ..... 15/229.1

FOREIGN PATENT DOCUMENTS

EP 1163874 A1 12/2001 ..... A47L/13/20

* cited by examiner

*Primary Examiner*—Terrence R. Till
(74) *Attorney, Agent, or Firm*—Wm. Bruce Day

(57) ABSTRACT

A mop head uses a ribbon of non-woven absorbent synthetic material folded lengthwise in multiple thicknesses. The ribbon is formed into a coiled wrapping which is collapsed centrally to provide opposite arms and a center of double thickness with top and bottom layers. A center strip of binder material extends longitudinally in this position between the top and bottom layers. Spaced rows of stitching secure the center strip to the top and bottom layers.

3 Claims, 1 Drawing Sheet

MOP HEAD WITH BINDER STRIP

FIELD OF THE INVENTION

This invention relates to cleaning mops and materials and the method for making same which uses inexpensive, generally waste materials.

BACKGROUND OF THE INVENTION

Cleaning devices, mop and wipes and covers have historically been made from cotton or synthetic fibers which are twisted and formed into strands and the strands formed into yarns. The yarns may be woven on looms to produce sheet form goods. These woven fabric articles are made in more or less degrees of costs. An alternative to traditional fiber yarns has been the use of non-woven cellulose/wood pulp fabrics such as used in tea bags, food and industry machine filters, disposable uniforms, packaging, paper wipes, facial tissue, paper towels and the like. Waste products result from the manufacture of these items. Applicant's invention provides a novel approach to the use of these waste products. A strip of inexpensive or waste material is folded and center stitched to create a multiple thickness ribbon which may serve as a yarn substitute. Mops can be made using this yarn substitute ribbon. A mop made using this type of yarn substitute provides an inexpensive mop which is an alternative to inexpensive mops which have typically used the cheapest fibers or reclaimed fibers in the spinning process. Other mops have used stacks of fabrics from which strips are cut to form flat ribbons or strings and yet others have processed non-woven materials using special stretching and twisting techniques which reduce absorbency but add sufficient strength to make a useful mop or other cleaning device. Some are less or more absorbent than others and some are sturdier in use than others. The present invention presents a novel solution to the disposable cleaning article and mop problem by providing a strip or ribbon of material which is formed into a mop which retains its shape, strongly secured at its headband and is absorbent yet sufficiently robust to provide effective scrubbing and cleaning ability. Disposable mops can be made using the disclosed method.

DESCRIPTION OF THE DRAWINGS

The following drawings are provided as illustrative examples of the present invention.

DESCRIPTION OF THE PREFERRED AND ALTERNATE EMBODIMENTS

As required, a detailed description of the preferred is disclosed herein, however, other embodiments or configurations may be apparent based upon the following description to those having ordinary skill in the art.

Figure 1:
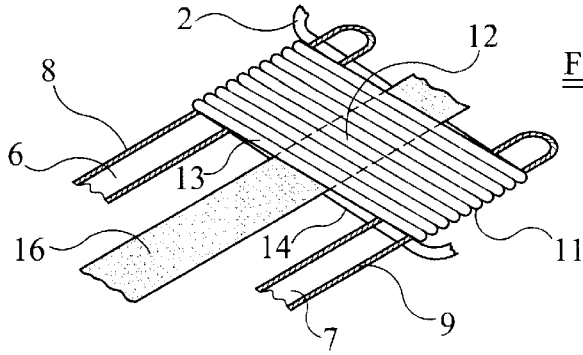
FIG. 1 is a perspective, fragmentary view of a mop strand ribbon being wound on a mop making machine.
Figure 2:
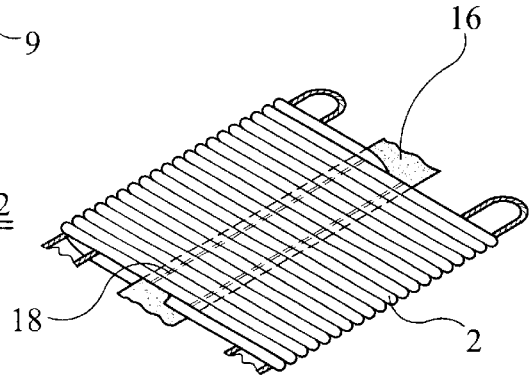
FIG. 2 is a perspective, fragmentary view of a second step in the process of making a mop.
Figure 3:
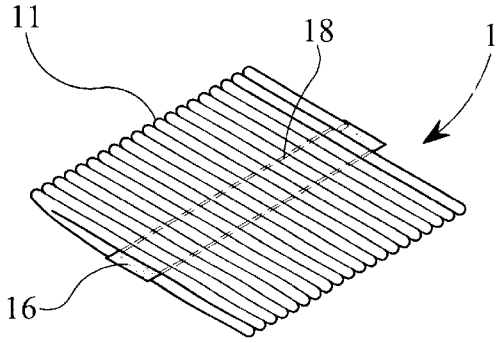
FIG. 3 is a perspective, fragmentary view of a section of mop yarn removed from the mop making machine.
Figure 4:
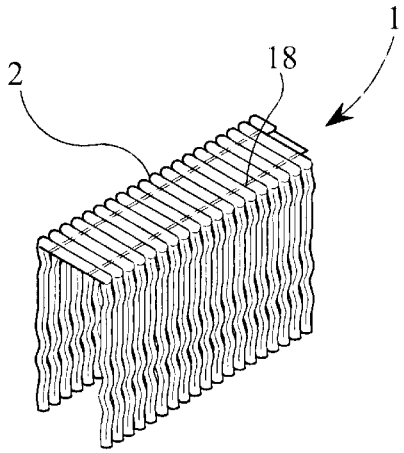
FIG. 4 is a perspective, fragmentary view of the mop shown in FIG. 3. ready for connection to a mopping fixture.

The reference numeral 1, FIG. 1, generally indicates a mop head according to the present invention. The mop head

1 is made from a ribbon 2 of non-woven absorbent synthetic material folded lengthwise in multiple thicknesses. The material is that used in the manufacture of tea bags, food and industry machine filters, disposable uniforms, packaging, and the like. It is a waste material remaining from the manufacture of such items and are the trimmings or ends of rolls of such material. The material differs in resistance to abrasion, absorbency, longevity, abrasive qualities and other attributes. Because the ribbon can be put to various purposes as a substitute in mops, the qualities of the material are selected based upon the proposed use.

Figure 5:
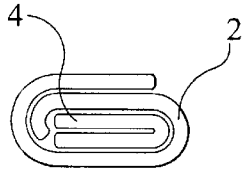
FIG. 5 is a cross-sectional view of the mop ribbon used in the present invention.

Referring to FIG. 5, the ribbon 2 is generally formed of a strip of the material which is folded or rolled longitudinally to provide overlapping layers of multiple thickness. The ribbon 2 may include an inner filling of scrap or other highly absorbent material 4.

The ribbon 2 is processed through a mop winding machine which, as commonly used in the industry, has opposite arms 6 and 7 with respective traveling chains 8 and 9. The arms 6 and 7 are typically supported at their rear ends only and are unsupported at the outlet ends so that a mop head wound thereon can be separated from the arms 6 and 7 without need for cutting. The chains 8 and 9 are rear-driven both by sprockets and travel forwardly along the outer edges of the arms 6 and 7 and return along the inner edges. A machine winding arm (not shown) winds the ribbon 2 around the spaced arms 6 and 7 to create a coiled wrapping 11 which is collapsed centrally to provide a center 12 of double thickness with top and bottom layers 13 and 14. A center strip 16 of binder material extends longitudinally, as from a reel mounted in the mop making machine, and is positioned between the top and bottom layers 13 and 14 of the coiled wrapping 11. The center strip 16 is of varying width, but preferably is several inches wide and is of much narrower width than that of the coiled wrapping 11. The center strip 16 is preferably of non-woven absorbent synthetic material and is likewise a waste material from other manufacturing operations. The center strip 16 is sown in place by spaced rows of stitching 18.

The coiled wrapping 11 with center strip 16 held in place by the stitching 18 is then severed as it comes off of the mop making machine arms 6 and 7 into lengths suitable for a mop head. The lengths may be relatively short such as 4–6" when the mop head 1 is in the form of a wet mop or the lengths could be quite long when making a dust mop.

Certain forms of the invention have been illustrated and described herein. The invention is not to be limited thereto except insofar as set forth in the following claims.

What is claimed and desired to be protected by Letters Patent is:

1. A mop head comprising:

a) a ribbon of non-woven absorbent synthetic material folded lengthwise in multiple thicknesses;

b) said ribbon formed into a coiled wrapping collapsed centrally to provide opposite arms and a center of double thickness with top and bottom layers; and c) a center strip of binder material extending longitudinally and positioned between said top and bottom layers, and spaced rows of stitching securing said center strip to said top and bottom layers.

2. The mop head set forth in claim 1 wherein said ribbon is formed of several layers of wrapped material with an inner filling of absorbent material.

3. An absorbent pad for cleaning comprising:

a) a ribbon of non-woven absorbent synthetic material folded lengthwise in multiple thickness;

b) said ribbon formed into a coiled wrapping collapsed centrally to provide opposite arms and a center of double thickness with top and bottom layers; and c) a center strip of binder material extending longitudinally and positioned between said top and bottom layers, and spaced rows of stitching securing said center strip to said top and bottom layers.

* * * * *